United States Patent [19]

Shichida

[11] Patent Number: 4,957,454

[45] Date of Patent: Sep. 18, 1990

[54] PIN JACK

[75] Inventor: Akihito Shichida, Higashiosaka, Japan

[73] Assignee: Hosiden Electronic Co., Ltd., Yao, Japan

[21] Appl. No.: 247,193

[22] Filed: Sep. 21, 1988

[30] Foreign Application Priority Data

Sep. 29, 1987 [JP] Japan ..... 62-149125[U]

[51] Int. Cl.[5] ..... H01R 13/73

[52] U.S. Cl. ..... 439/544; 439/668

[58] Field of Search ..... 439/675, 578–585, 439/63, 668, 669, 544, 550

[56] References Cited

U.S. PATENT DOCUMENTS

| | | | |
|---|---|---|---|
| 2,221,280 | 11/1940 | Woodside | 439/668 |
| 2,632,788 | 3/1953 | Ustin | 439/669 |
| 4,593,464 | 6/1986 | Williams et al. | 439/675 |
| 4,747,786 | 5/1988 | Hayashi et al. | 439/675 |

OTHER PUBLICATIONS

Evans et al, "Terminal for Coaxial Cable", IBM Disclosure Bulletin, p. 252 (Aug. 1966).

*Primary Examiner*—David L. Pirlot
*Attorney, Agent, or Firm*—Armstrong, Nikaido, Marmelstein, Kubovcik & Murray

[57] ABSTRACT

A pin jack, an electric connector element having a bored hole to receive a pin plug, is improved to have flexible adaptability in light of the size of openings to be formed on a terminal plate. Normally audio class pin jacks are non-coaxial, but radio level or higher frequency class pin connectors are of coaxial cable formation. These different kinds of connectors need openings with different diameters which lead to terminal plates having mixed size openings in order to meet mixed mountings. This difficulty is solved by rendering a inventive pin jack with two different concentric mounting diameters, of which a larger one of the diameters, which may be referred to as jacket ring, is externally formed to cover a portion of a cylindrical extension and is to be integrally connected to a cubic body base. Thus, with use of a smaller diameter or a larger diameter, the inventive pin jacks are advantageously secured on a given terminal plate having openings, no matter whether the openings are of conventional non-coaxial pin jack size or coaxial size.

2 Claims, 3 Drawing Sheets

PIN JACK

FIELD OF THE INVENTION

This invention relates to a pin jack which will be advantageously applied to an electrical connection in a audio or video device, and the like, and further relates to a terminal plate mounted with pin jacks of the present invention.

DESCRIPTION OF THE CONVENTIONAL ART

Customarily, a pin jack indicates an electrical element which will act as connector in a wave frequency range less than a radio frequency range, for instance, an audio range, or in the range of dispensing with coaxial cable formation. In assembling an intended device, such a connector will be mounted in or inserted through an opening formed on a terminal plate or a connector board. On the rear of the plate, the inserted pin jack will be secured to the plate by an appropriate fixing means which is previously prepared.

However, in the electronic assembly business, all of what will be mounted on a given terminal plate are not always limited to conventional pin jacks, non-coaxial cable formation, but conventional pin jacks may share the same plate with a different kind of electronic element which has been manufactured according to a different standard to suit a radio frequency, for instance, BNC connector, which requires the coaxial cable formation. In other words, it is likely that during assembly of mounting electronic connectors on a terminal plate, an application of mixed kinds of connectors which need different openings in size on a plate may be required. The difficulty with such an assembly is that a terminal plate should have a plurality of openings in different sizes so as to suit the mixed kinds of connectors. Therefore a plurality of plates having different designs with openings should be provided to avoid costly and inconvenience with terminal plates.

SUMMARY OF THE INVENTION

This invention is intended to solve the difficulty as noted above by an improvement in the design of the connecting elements, instead of dealing with the design of the terminal plate. That is, the present invention relates to a pin jack which can be applied to both an opening of a conventionally sized pin jack and an opening in conformity with another standard.

The inventive pin jack comprises a conventional body, made of an insulating material, which is generally composed of a cubic base integrally connected to a cylindrical extension. A pin plug hole is bored in the cylindrical extension to receive a pin plug in a longitudinal center. The cylindrical extension is covered with a cylindrical cover, made of electrical conductivity, leaving an uncovered area around the pin hole. Prong elements are mounted to extend on the body base. The inventive pin jack is featured in having a jacket ring or enlarged shell which includes or sheathes a portion of the cylindrical extension with a larger concentric diameter than that of the cylindrical extension. When the inventive pin jack is applied to an opening having a pin jack size, the jacket ring is not allowed to go through the opening and abutted on the back side of the plate. When the inventive pin jack is applied to an opening having a radio class size opening, the jacket ring is made to fit in the opening tightly or to stay rigidly inside the round edge of the opening.

Therefore, the inventive pin jacks have flexible adaptability of being mounted on a terminal plate which has openings suitable either to non-coaxial connectors or to coaxial connectors.

BRIEFING OF THE DRAWINGS

Figure 4A:
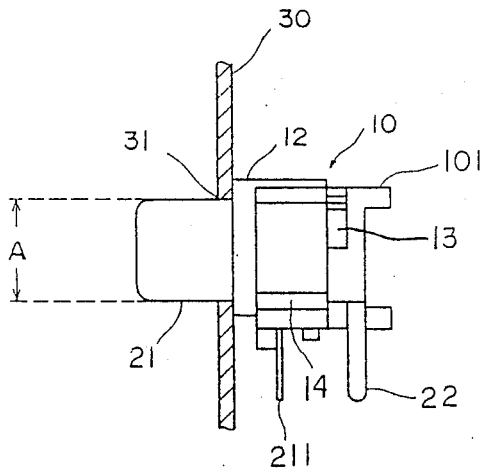
Figure 4B:
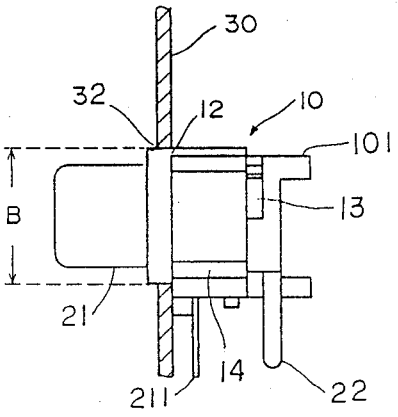

FIGS. 4(*a*) and 4(*b*) each show a side view, partly sectioned, to show how an inventive pin jack is mounted on the terminal plate.

These drawings are presented by way of illustration and therefore these should not be construed as limiting the invention.

DESCRIPTION OF THE EMBODIMENT(S)

Figure 1:
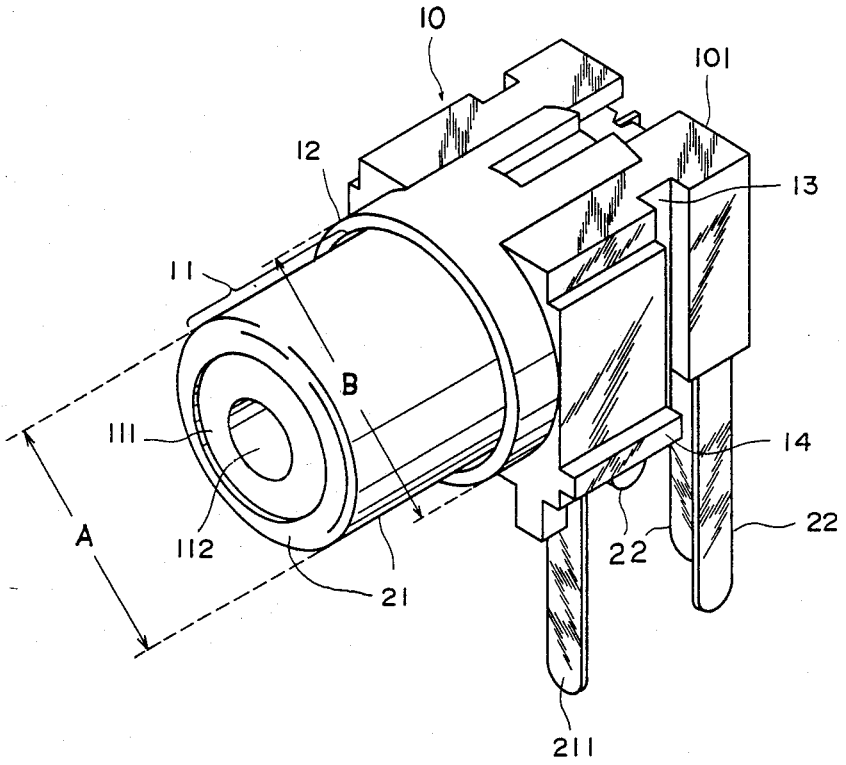
FIG. 1 is a perspective view to show the whole appearance of the inventive pin jack.
Figure 2:
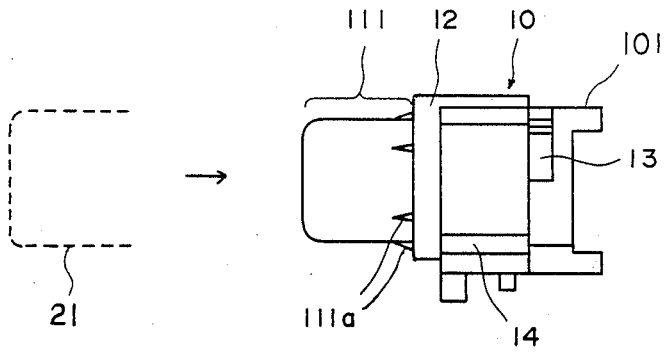
FIG. 2 is a side view of the body mainly.

Featuring an inventive embodiment with reference to FIG. 1, in view of structure, an inventive pin jack comprises a body 10, made of an insulating material. The body 10 comprises a cubic base 101 integrally connected to a cylindrical extension 111 wherein a pin plug hole 112 is bored at its longitudinal center. A cylinder portion 11 covered with a cylindrical cover 21, made of electrical conductivity, forms a forward projection. Prong elements 22, 211 are mounted to extend on the body 10 so as not to interfer or to be spaced apart from the projection of the body 10. Additionally provided is a jacket ring 12 which includes or sheathes a backward portion of the cylinder 111 or a portion of the cylinder 111 toward the body base 101. The jack ring 12 has concentric diameter larger than that of the covered connector portion 11.

The body 10 is, made of a kind of synthetic resin having good insulartion and is shaped to be generally a cubic base 101 integrally connected with a projecting cylinder 111. Provided on opposite two side faces of the body bese 101 are a ridge guide 13 and a clamp groove 14 which will be used in setting the pin jack on a terminal plate 30 (see FIGS. 3 and 4, however a means for engaging with the elements 13, 14, are not shown). On the cylindrical face 111 of the body 10, a plurality of small locking element 111*a*, halved-pyramid in shape, are projected circumferentially to impart firm over-fit with the cover 21. The pin plug hole 112 for receiving a pin plug (not shown) is bored at a longitudinal center of the body 10. Around the backward portion of the cylinder 111 or around a portion toward the body base 101, a jacket ring 12 is provided to surround with a space inside. Thus, the invention pin jack is assumed to have two concentric diameters; one indicated by A with the cylinder 11 which has been fitted over with the cover 21 and the other indicated by B with the jacket ring 12 (see FIG. 1), wherein it is also assumed that the first mentioned A is designed to fit with an opening for a conventional pin jack and the second mentioned B is designed to fit with an opening for some other standard as noted before, for instance, a BNC connector.

Additionally, the jacket ring 12 is made of an insulating material and is advantageously formed integrally with the body 10. A space between the jacket ring 12 and the cover 21 may be conveniently utilized for fitting the cover 21 over the cylinder 111 to form the convered clylinder or connector portion 11. Normally the cover 21 is manufactured by blanking and drawing work of a metal plate, which inevitably produces a thicker end. The thicker end portion is required to go through the space in the fitting as noted above.

Figure 3:
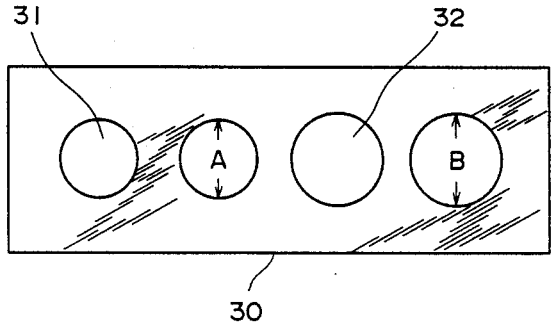
FIG. 3 is a schematic plan view to show a terminal plate to be mounted with pin jacks.

Refrring to the prong elements 211, 22, the prong 211 is a grounding one which is connected to the conductive cover 21. There are three other prongs 22, shown in FIG. 1 which, are mounted or inserted into a back side of the body base 101. These three prongs 22 comprise one prong to be connected to a pin of a pin plug (not shown) and the other prong to form a switch circuit. In the drawings, the prongs 211, 22 are mounted to be transversal to the hole 211, however, such an arrangement is not limitative. For instance, these prongs may be mounted to extend in the same direction as the hole 211. Referring to FIG. 3 to show the use of a pin jack thus obtained, FIG. 3 shows a terminal plate 30 which illustratively has two sizes of openings, A 31 and B 32. The opening A is suited only to a conventional pin jack and B is suited only to another connector element, for instance, a BNC connnector.

When applying the inventive pin jacks to the terminal plate as shown in FIG. 3, for the opening 31 having A size, the pin jack is secured with the aboutting end of the jacket ring 12 on the plate, which may be noted as A mounting (see FIG. 4(*a*)). For the opening 32 having B size, the pin jack is secured to the plate with the jacket ring 12 fitting into the open B, which may be noted as B mounting (see FIG. 4(*b*)). Accordingly, the invention pin jacks are permitted to be secured in either A of B mode. Thus, there is no need to change a terminal plate conform with a difference in the electrical connectors, pin jack or BNC connected, which means that it is unnecessary to prepare a plurality of molds for the terminal plates.

Although a terminal plate mounted with a number of the inventive pin jacks is not shown in the drawings, those skilled in the art are readily invited to assume such a terminal plate through the disclosures herein.

What is claimed is:

1. A pin jack which comprises a body having, at a longitudinal center, a bored hole to receive a pin plug, said body made of insulating material, said pin jack comprising:

a body base;

a cylindrical extension integrally connected to said body base and extending outward from a front of said body base;

a cylindrical cover made of conductive material which covers a first end of said cylindrical extension;

prongs mounted on the body base;

a jacket ring, having a concentric diameter larger than that of the cylindrical extension, said jacket ring covering a second end of said cylindrical extension which is toward the body base; and a plurality of locking elements, projecting circumferencially from the body base, which fit over said cylindrical cover.

2. A pin jack as defined in claim 1, wherein the jacket ring is made of insulating material and formed integrally with the body.

* * * * *